US005881792A

United States Patent [19]

Cheng

[11] Patent Number: 5,881,792

[45] Date of Patent: Mar. 16, 1999

[54] SHADE ROLLER

[76] Inventor: Li-Ming Cheng, No. 12, Lane 23, Le Jen Rd., Ling Ya Dist., Kaohsiung, Taiwan

[21] Appl. No.: 919,532

[22] Filed: Aug. 28, 1997

[51] Int. Cl.[6] ..... A47G 5/02

[52] U.S. Cl. ..... 160/263; 160/323.1

[58] Field of Search ..... 160/263, 262, 160/323.1, 325, 326, 21, 370.22, 23.1

[56] References Cited

U.S. PATENT DOCUMENTS

| | | | |
|---|---|---|---|
| 1,071,158 | 8/1913 | Hurlbut | 160/262 X |
| 1,243,923 | 10/1917 | Dargo | 160/323.1 X |
| 1,800,654 | 4/1931 | Nelson | 160/262 |
| 3,203,461 | 8/1965 | Gossling et al. | 160/323.1 |
| 3,362,461 | 1/1968 | Stark | 160/323.1 |
| 3,521,694 | 7/1970 | Anderson | 160/323.1 |
| 3,580,323 | 5/1971 | Gossling et al. | 160/323.1 X |
| 4,006,770 | 2/1977 | Ferguson | 160/323.1 X |
| 4,102,384 | 7/1978 | Gossling et al. | 160/263 |
| 4,157,108 | 6/1979 | Donofrio | 160/263 |
| 4,619,305 | 10/1986 | Comeau | 160/263 |

*Primary Examiner*—David M. Purol
*Attorney, Agent, or Firm*—Renner, Otto, Boisselle & Sklar, P.L.L.

[57] ABSTRACT

A shade roller includes a roller, a first tube slidably received within the roller and a second tube having a part of the first tube securely received therein. Due to the extendable characteristics of the first tube and an outer diameter of the second tube being manufactured to be the same as that of the roller, a user is able to adapt to different widths of different windows and roll up or down a shade which is originally wound around the shade roller evenly.

2 Claims, 6 Drawing Sheets

SHADE ROLLER

FIELD OF THE INVENTION

The present invention generally relates to a shade roller, and more particularly to a shade roller which is able to adapt to windows or the like of different widths.

BACKGROUND OF THE INVENTION

Shade rollers are widely used on balconies or windows to reach a purpose of blocking the sun or on indoor-walls to enrich the color of the room. Most shade rollers are provided with an ability that when the shade is pulled down to an extent, a fitting device mounted within the roller is able to maintain the shade at that extent, and when the shade no longer needs to be drawn, a user will only need to pull down the shade slightly and then release it, whereby the shade roller is able to roll back the shade automatically due to the recovery force stored within the roller when rotated to allow extension of the shade.

However, such a shade roller suffers a serious drawback concerning parts kept in stock for manufacturing of the rollers, because the various size requirements of the windows means manufacturers will need to have all sizes of the rollers to fulfill the needs. Such need for comprehensive stocks of parts incurs extra expenses of manufacturing different sizes of rollers, leasing for a warehouse for storing products, etc.

To solve such a problem of excessive stocks, there is provided a shade roller structure as shown in FIG. 6. The shade roller 80 includes a roller 81, a first tube 90 slidably received within the roller 81, a positioning cap 82 securely mounted to a first end of the roller 81, a knob 91 pivotally connected to a first end of the first tube 90, a first U-shaped rod 83 and a second U-shaped rod 92. A first end (not numbered) of the first U-shaped rod 83 is respectively inserted into the positioning cap 92 and the roller 81 and a coil spring 85 is securely mounted onto a portion 84 of the first U-shaped rod 83 which is inserted into the roller 81. A first end of the second U-shaped rod 92 is respectively inserted into the knob 91 and a part of the first tube 90 which extends out from the roller 81. A shade 95 is wound around a shaft (not numbered) combined by the roller 84 and an extension of the first tube 90. Second ends of the first U-shaped rod 83 and of the second U-shaped rod 92 are respectively and securely provided with one of a pair of brackets 86, 94. Therefore, when both of the brackets 86, 94 are securely attached on a surface such as a wall and the shade roller structure extends therebetween, the shade 95 is able to be pulled down by a user and the shade 95 is then able to be positioned by a bracket (not shown) whenever a desired length of the shade 95 is reached. When the user needs to roll up the shade 95, he/she simply pulls down the shade 95 to disengage the limitation of the bracket, then the shade 95 will be rolled back by a recovery force created by the coil spring 85. It is to be noted that due to the first tube having the adaptability of different widths, the structure solves the over stocking problems. However, if the first tube 90 is to be slidably received within the roller 81, a diameter of the first tube 90 must be smaller than that of the roller 81, such that a circumferential surface combined with the roller 81 and the first tube 90 is inclined toward the knob 91, which shows no difference when the shade 95 is completely pulled out from the shaft, but a great difference when the shade 95 is partly pulled out and partly is still wound around the shaft. Due to the inclination of the shaft, the shade 95 will not be wound around the shaft evenly, which spoils the appearance of the blind, the window and a view therethrough.

From the previous description, it is noted that to fully solve the aforementioned problems, alternatives and/or improvement(s) to the conventional shade rollers are thus required. A shade roller constructed in accordance with the present invention tends to mitigate and/or obviate the aforementioned problems.

SUMMARY OF THE INVENTION

In accordance with one aspect of the invention, the shade roller includes a roller, a shaft fixedly received within the roller, a coil spring mounted around the shaft, a first cap securely mounted to a first end of the roller, a first tube slidably received within the roller, a second cap securely mounted to an end of the first tube and a second tube a first end of which engages with a second end of the roller and a second end of which has the second cap protruding therefrom. When the first tube is extended out from the roller to fulfill the customer's specific width requirement, a smooth peripheral junction will be accomplished between the roller and the first tube, due to an outer diameter of the second tube being equal to an outer diameter of the roller. Thus, a shade is allowed to be evenly rolled up and down from a periphery formed by the roller and the second tube.

The main objective of the invention is to provide a shade roller, with which a user is able to adapt to different widths of different windows.

Another objective of the invention is to achieve smooth and even winging of a shade roller by providing a cap having a body extending outward and provided with a plurality of ribs integrally formed on a periphery thereof, and the second tube is able to be securely connect with the first tube. The cap further has a disc securely connected with the body. The ribs and the disc are so sized and configured that when the cap is inserted into the second end of the first tube, the ribs of the body will securely engage with an inner periphery of the first tube and the disc will form a tight engagement to a second end of the second tube.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
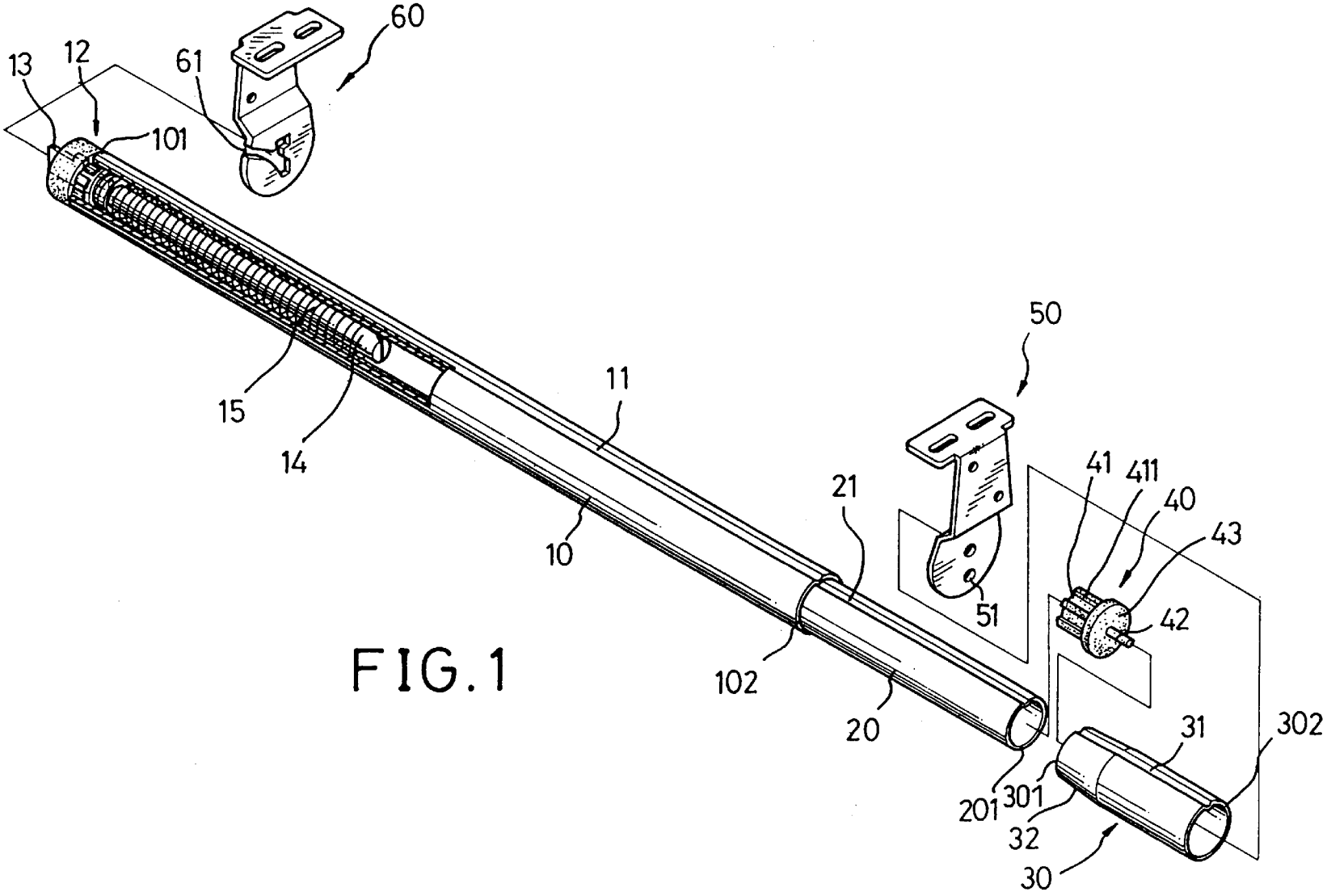
FIG. 1 is an exploded view partly in cross section of a shade roller constructed in accordance with the present invention.

Referring to FIG. 1, one preferred embodiment of a shade roller 1 constructed in accordance with the present invention is shown. The embodiment intends in descriptive purpose and not in any form to limit the scope of the present invention, such that the features of the present invention also apply to various forms of shade roller.

In the preferred embodiment of FIG. 1, the shade roller 1 of the invention includes a roller 10, a first cap 12 securely mounted to a first end 101 of the roller 10, a shaft 14 received within the roller 10, an extension 13 securely mounted to a distal end of the shaft 14, a coil spring 15 mounted around the shaft 14, a first tube 20 slidably received within the roller 10, a second tube 30 a first end 301 of which engages with a second end 102 of the roller 10 and a second cap 40 securely mounted to an end 201 of the first tube 20 and having a body 41 provided with a plurality of ribs 411 formed on a periphery thereof and a rod 42 extending out from a disc 43 in a direction opposite to that of the body 41. Furthermore, the shade roller 1 of the invention includes a first bracket 50 receiving the rod 42 of the second cap 40 rotatably therein and a second bracket 60 defining a gap 61 therein for securingly receiving the extension 13 therein.

Figure 2:
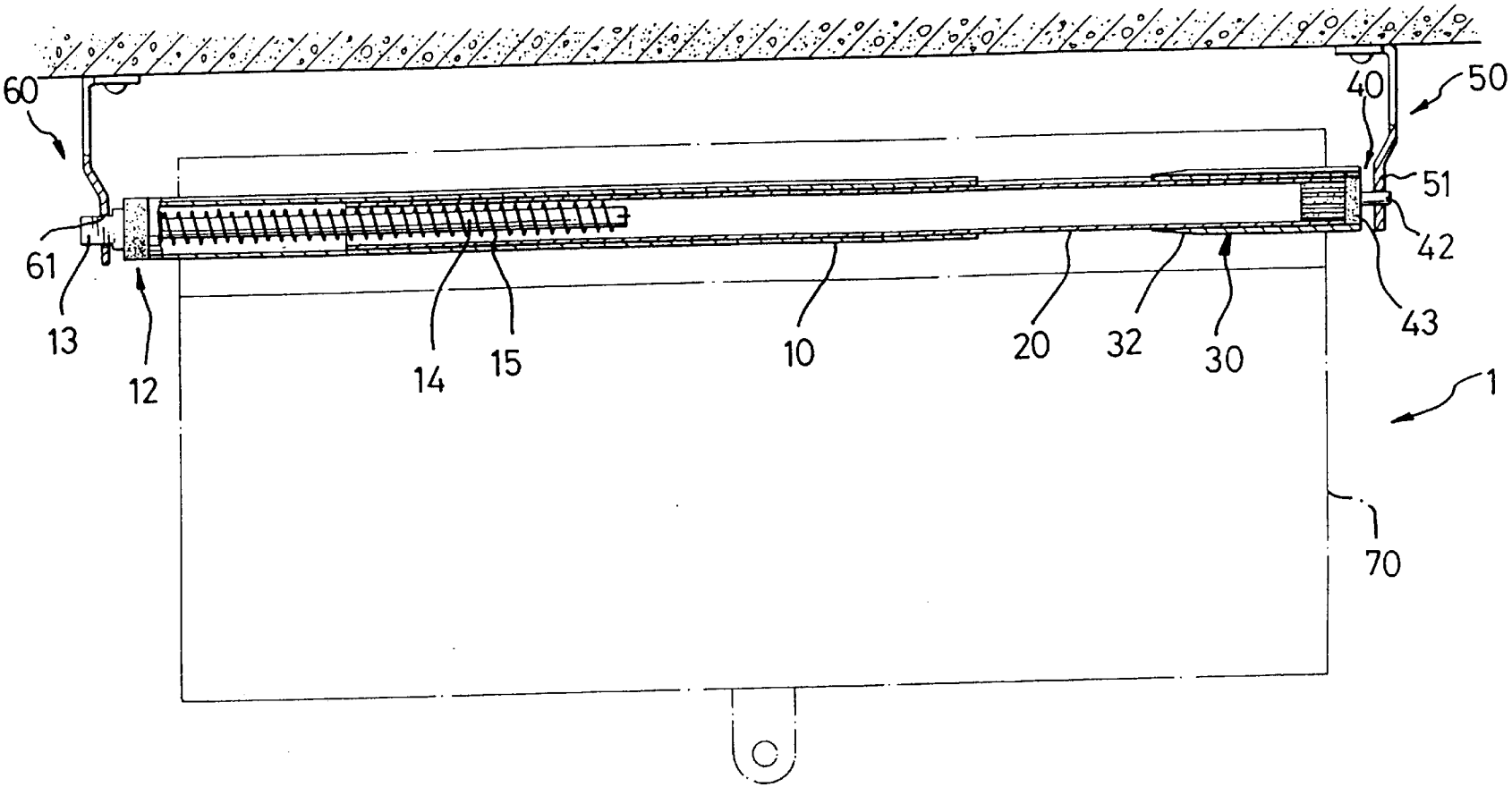
FIG. 2 is a sectional view of one preferred embodiment of the shade roller of the invention when in assembly.

Still referring to FIG. 1 and taking FIG. 2 for reference, a first groove 11 is defined in a periphery of the roller 10 and a second groove 21, a third groove 31 are respectively defined in the first tube 20 and the second tube 30. When the first tube 20 is partly and slidably received within the roller 10 and the second tube 30 encloses the first tube 20 therein, a generally smooth periphery combined from the roller 10 and the second tube 30 is achieved.

Figure 3:
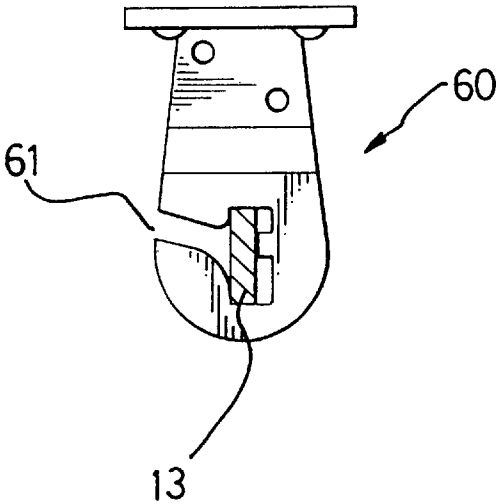
FIG. 3 is a side view of a bracket used with the shade roller of the invention.

When in assembly, the shaft 14 is inserted into the roller 10 and a first end (not numbered) of the coil spring 15 is securely engaged with a distal end of the shaft 14 and a second end (also not numbered) of the coil spring 15 is securely engaged with the first cap 12 which is securely mounted to the first end 101 of the roller 10. Then, the extension 13 securely engages with the shaft 14 in a way that when the roller 10 together with the first cap 12 rotates, the coil spring 15 will store a recovery force therein. After the above mentioned assembly process is finished, the first tube 20 is slidably extended out from the roller 10 for a specifically required length, and the body 41 of the second cap 40 is inserted into the second end 201 of the first tube 20 and securely abutted to an inner periphery of the first tube 20 via the ribs 411 of the body 41. The disc 43 abuts against the second end 201 of the first tube 20, the second tube 30 encloses an extended part of the first tube 20 via the correspondence of the third groove 31 to the second groove 21 and thus the disc 43 of the second cap 40 securely abuts an inner periphery of a second end 302 of the second tube 30. When the above described parts are assembled, and the first bracket 50 and the second bracket 60 are respectively mounted to a predetermined position, the rod 42 of the second cap 40 is rotatably inserted into a hole 51 defined in the first bracket 50 and the extension 13 which is securely engaged with the shaft 14 is then fixedly received within the gap 61 of the second bracket 60, as shown in FIG. 3.

Figure 4:
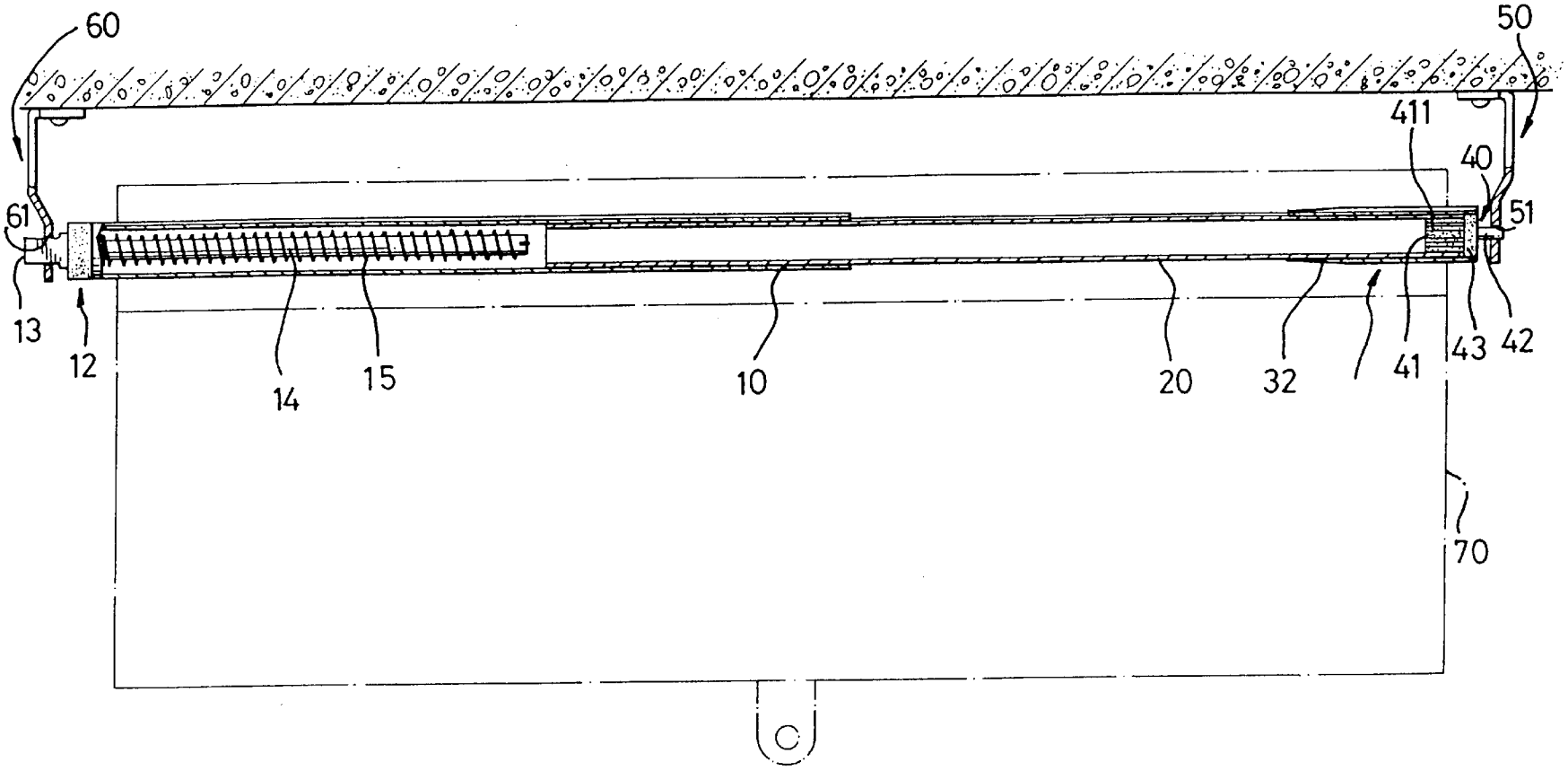
FIG. 4 is a sectional view of a second preferred embodiment of the shade roller of the invention showing that a first tube extends and a second tube is then adapted to a length variation of the first tube.

Due to the extension 13 being securely received within the gap 61 of the second bracket 60 and the rod 42 being pivotally received within the hole 51 of the first bracket 50, when the roller 10 rotates, the first cap 12 and the second tube 30 together with the second cap 40 rotate as well. It is to be noted from FIG. 1 and especially from FIG. 4 that the first end 301 of the second tube 30 is constructed to be a cone 32 and since the outer diameter of the second tube 30 is the same as that of the roller 10 and a width of a window is limited to an extent, a shade 70 is able to be evenly wound around the shade roller 1 of the invention.

Figure 5:
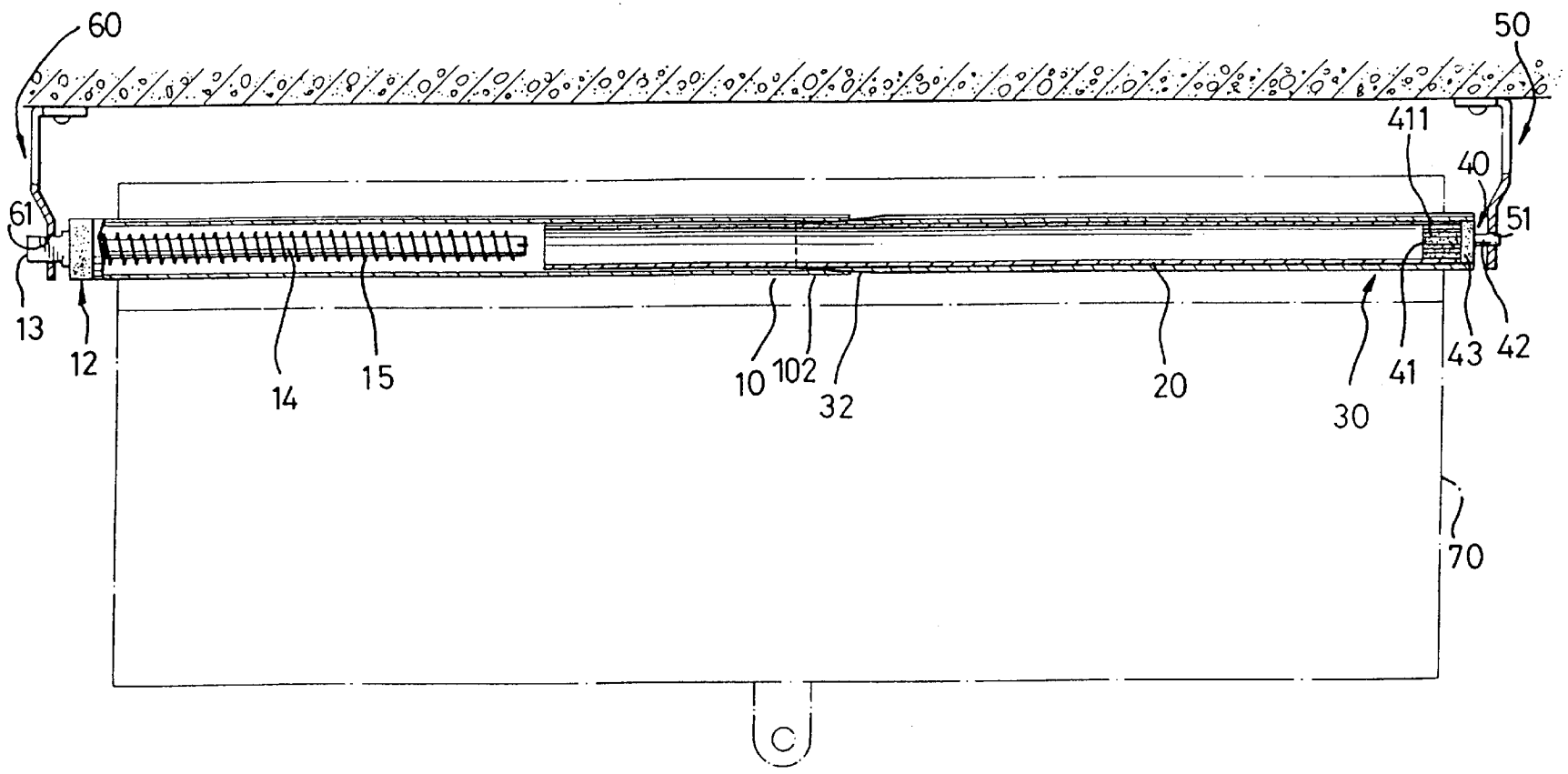
FIG. 5 is a sectional view of a conventional shade roller.
Figure 6:
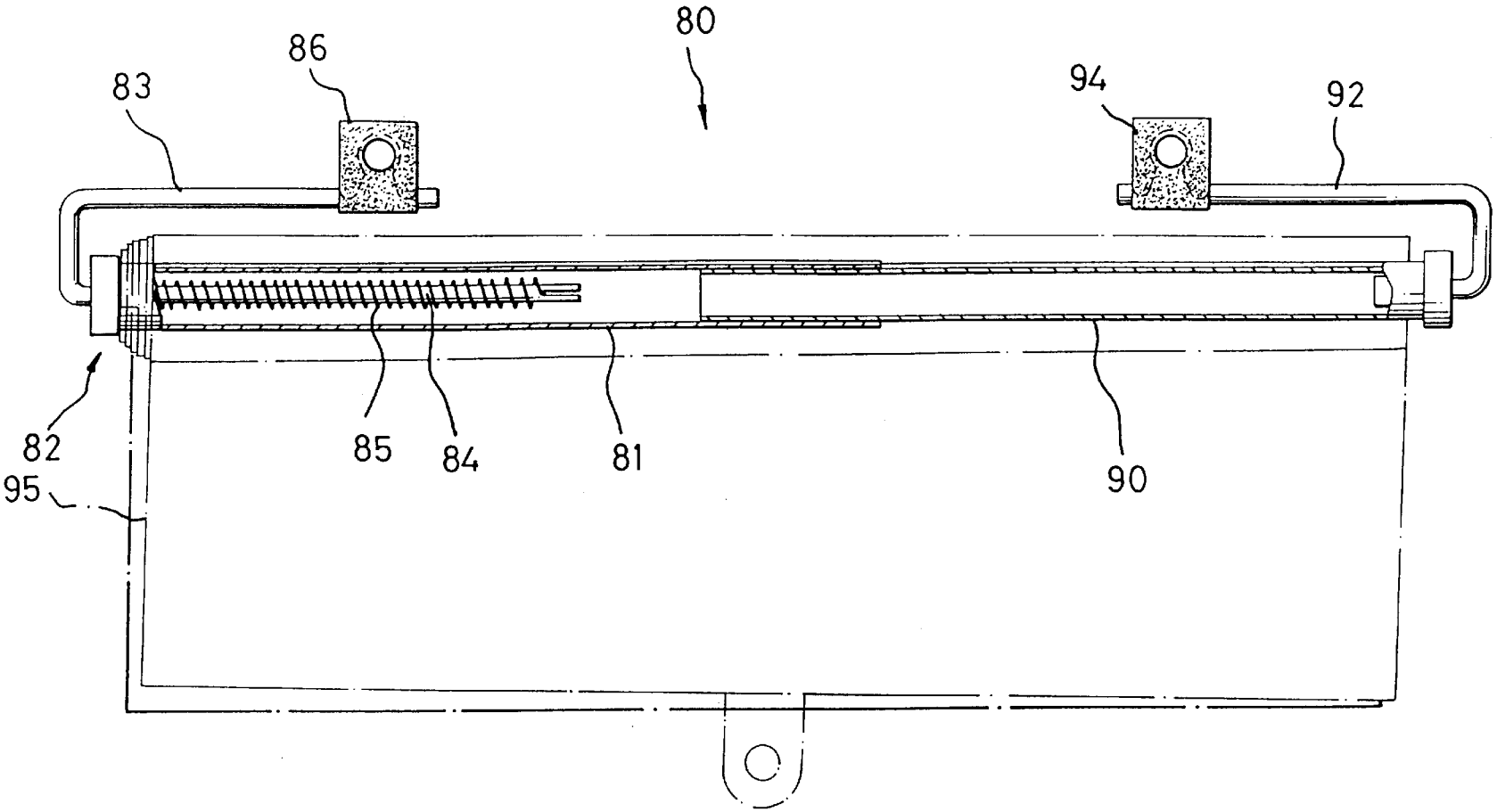
FIG.6 PRIOR ART
FIG. 6 is a schematic view showing a structure of a conventional shade roller.

Referring to FIG. 5, another preferred embodiment of the invention is shown. A length of the second tube 30 is adjusted to a length of the extended part (not numbered) of the first tube 20 in a way that when the first tube 20 extends out from the roller 10, and the cone part 32 of the second tube 30 is inserted into the second end 102 of the roller 10, a smooth and a peripheral surface combined by the periphery of the roller 10 and the periphery of the second tube 30 is achieved. Therefore, the shade 70 can be more evenly rolled up and down by the shade roller 1 of the present invention.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A shade roller comprising a roller having a first groove defined therein, a first cap securely mounted to a first end of said roller, a shaft securely received within said roller, an extension securely mounted to a distal end of said shaft, a coil spring mounted around said shaft, a first tube slidably received within said roller and having a second groove defined to correspond to said first groove, a second cap securely mounted to an end of said first tube and having a body provided with a plurality of ribs formed on a periphery thereof and securely abutted to an inner periphery of said first tube, a disc securely engaged with said body and a rod extending out from said disc in a direction opposite to that of said body, a first bracket having said extension securely received therein and a second bracket having said rod of said second cap pivotally received therein, and wherein a second tube has a third groove defined to correspond to said second groove and an outer diameter which is the same as a diameter of said roller, said disc of said second cap is securely received within an end thereof, and said rod extends out from said end in a direction opposite to that of said body.

2. The shade roller as claimed in claim 1, wherein an end of said second tube is cone-shaped.

* * * * *